United States Patent [19]

Shimizu et al.

[11] 4,211,498

[45] Jul. 8, 1980

[54] PAPER CUTTING AND PERFORATED LINE FORMING DEVICE OF PRINTER

[75] Inventors: Munetaka Shimizu, Kawagoe; Yoshimasa Takeda, Tokyo, both of Japan

[73] Assignee: Copal Company Limited, Tokyo, Japan

[21] Appl. No.: 4,600

[22] Filed: Jan. 18, 1979

[30] Foreign Application Priority Data

Jan. 20, 1978 [JP] Japan ..... 53-4610
Jan. 20, 1978 [JP] Japan ..... 53-4611

[51] Int. Cl.[2] ..... B41J 3/24

[52] U.S. Cl. ..... 400/621; 83/879; 83/881; 101/93.07

[58] Field of Search ..... 400/621; 101/93.07; 83/63, 360, 575, 582, 879–881

[56] References Cited

U.S. PATENT DOCUMENTS

| | | | |
|---|---|---|---|
| 2,632,509 | 3/1953 | Skillman | 83/862 |
| 3,767,098 | 10/1973 | Pabodie | 400/621 X |
| 3,902,412 | 9/1975 | Pabodie | 101/93.07 |
| 4,165,191 | 8/1979 | Dickson et al. | 400/621 X |

FOREIGN PATENT DOCUMENTS

| | | | |
|---|---|---|---|
| 2607391 | 2/1976 | Fed. Rep. of Germany | 400/621 |

*Primary Examiner*—E. H. Eickholt
*Attorney, Agent, or Firm*—Haseltine, Lake & Waters

[57] ABSTRACT

The paper cutting and perforated line forming device of a printer including a slide plate pivoted to the machine frame of the printer for reciprocal movement. The paper cutting and perforrated line forming device comprises a spring-loaded paper cutting lever device pivoted to the printer machine frame and connected to the printer cutting device for moving the cutting device to the operative position when rocked against the spring load, a slide plate connection lever connected to the paper cutting lever device for rocking the lever device by the movement of the slide plate in one direction, a slide plate connection lever operation member to be operated by an electromagnetic device, a switching lever movable into and out of the operation path of at least one of the paper cutting device and paper cutting lever device. The paper cutting lever device includes a first lever pivoted to the slide plate connection lever and machine frame and a second lever pivoted to the machine frame and cutting device in an angular position relative to the first lever, whereby the paper cutting and perforated line forming operations are selectively performed on a paper.

7 Claims, 5 Drawing Figures

PAPER CUTTING AND PERFORATED LINE FORMING DEVICE OF PRINTER

BACKGROUND OF THE INVENTION

This invention relates to the paper cutting and perforated line forming device for a printer or the like.

In a prior art printer having a printing ribbon feed device, a paper feed device and a paper cutting and perforated line forming device, the paper cutting and perforated line forming device is designed to be operated through a lever device which is operated by an electromagnetic device after a predetermined printing operation on a rolled paper is completed, but the paper cutting and perforated line forming device requires a relatively high force for cutting the paper and accordingly, the electromagnetic device is required to be large in size and heavy duty. As a result, the prior art paper cutting and perforated line forming device has the inherent disadvantages that the increase in inertia force due to the increase in size of the electromagnetic device may cause a delay in the operation phase or the like as well as the increase in size and power consumption of the cutting and perforated line forming device which lead to the impediment in the reduction in size and improvement of the performance of the printer.

In another prior art printer having a printing ribbon feed device, a paper feed device, a stamping device and a paper cutting and perforated line forming device, the stamping device and paper cutting and perforated line forming device are designed to be operated through a lever device which is operated by a plunger after a predetermined printing operation on a rolled paper is completed, but the paper cutting and perforated line forming device requires a relatively high force for cutting the paper and accordingly, the plunger is required to be large in size and heavy duty. Thus, this prior art printer also has the disadvantages as described in connection with the first-mentioned prior art printer.

In order to eliminate the disadvantages inherent in the prior art printers, the inventors have developed an improved printer of the above-mentioned type which essentially comprises a slide member adapted to be reciprocally moved by a drive source, a paper cutting mechanism including a paper cutting member for reciprocal movement relative to a printed paper for cutting said paper, a connection member adapted to engage and disengage from said slide member and an electromagnetic means for controlling the engagement and disengagement of said connection member with respect to said slide member whereby when said electromagnetic means is operated in response to a paper cutting signal, said connection member is caused to engage said slide member to operate the slide member which in turn operates said paper cutting member and the improved printer is the subject of the co-pending U.S. patent application Ser. No. 956,360 filed Oct. 31, 1978 in the name of the same inventors.

SUMMARY OF THE INVENTION

The present invention is to provide an improved paper cutting and perforated line forming device suitably employed in the printer having a reciprocally movable slide plate as disclosed in the above-mentioned U.S. patent application Ser. No. 956,360. According to the present invention, the paper cutting and perforated line forming device is operatively interlocked with the slide plate to be operated thereby through the utilization of a high operation force obtainable from the slide plate whereby the paper cutting and perforated line forming device is simplified in construction and precisely operated while eliminating the disadvantages inherent in the prior art printers.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENT

The present invention will be now described referring to the accompanying drawings in which a printer having the paper cutting and perforated line forming device embodying the present invention incorporated therein.

Figure 1:
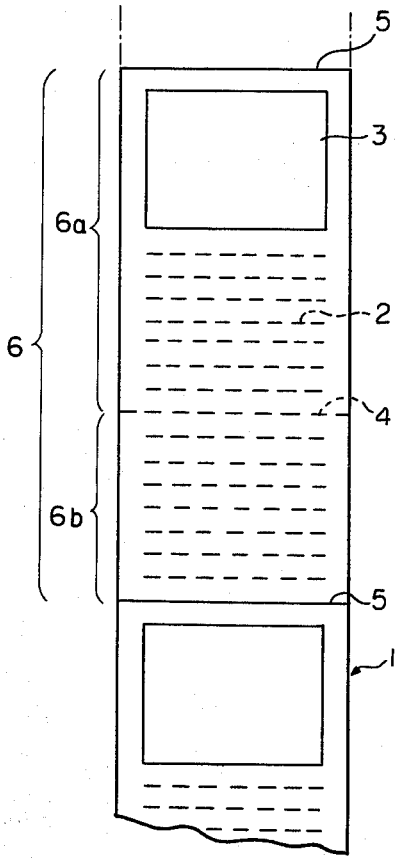
FIG. 1 is a fragmentary plan view of a receipt paper blank being processed by the paper cutting and perforated line forming device in a printer according to the present invention.

First referring to FIG. 1, there is fragmentarily shown a printed receipt paper 6 severed at the severing line 5 from the remaining portion of a receipt paper blank 1. The printed receipt paper 6 has necessary informations 2 printed in a substantial portion thereof, a minor stamped portion 3 and a perforated line 4 positioned in the center of the printed portion 2. In use, the printed receipt paper 6 is severed at the perforated line 4 to divide the receipt paper into the leading receipt portion **6*a* which is to be delivered to a customer and the trailing receipt portion 6*b* which is to be processed in a shop or store. After the printed receipt paper 6 has been severed from the remaining receipt paper blank 1 at the severing line 5, the receipt paper blank 1 is held in the printer with the portion to be printed positioned at the leading and in the next printing operation, a necessary information or informations 2 are printed in the portion immediately following the portion 3 to be stamped and then provided in the center of the printed portion 2 with a new perforated line 4 to define the leading receipt portion 6*a* for a customer and the trailing receipt portion 6*b* for processing in the shop or store on the printed portion 2 the trailing edge of which trailing receipt portion is defined by the next severing line 5 and the thus processed succeeding receipt paper 6 is then severed at the severing line 5 to be used in the same manner as the previous receipt paper 6. By repeating the procedure, a plurality of receipt papers 6 are in succession obtained from the receipt paper blank 1**.

Figure 2:
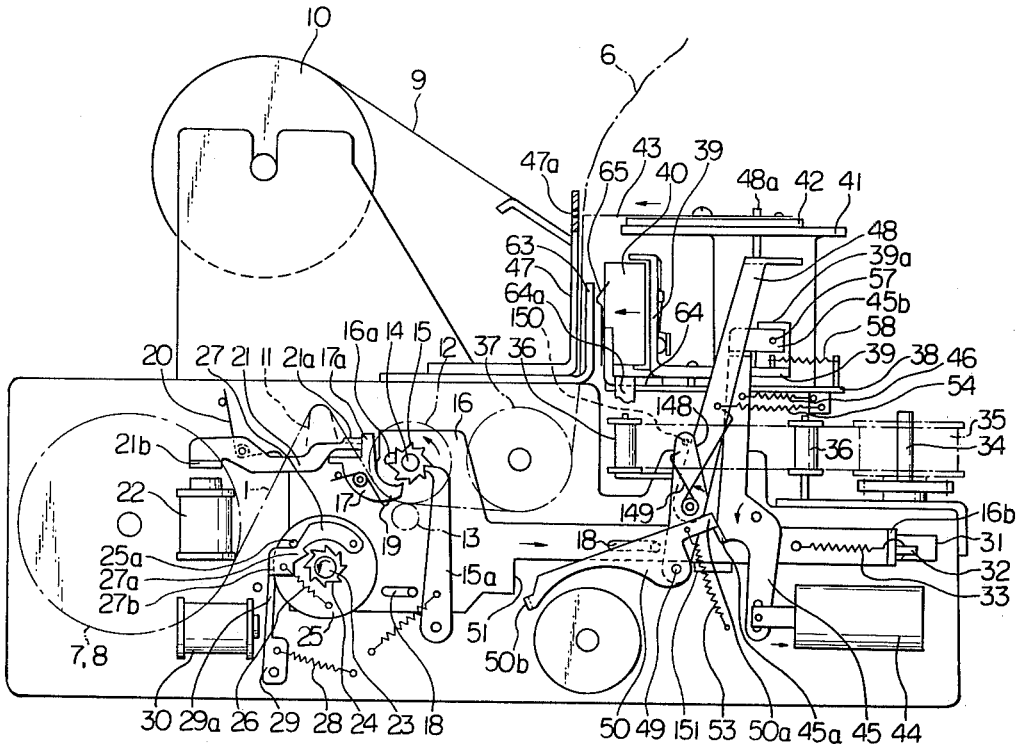
FIG. 2 is a schematic side elevational view of a printer in which said paper cutting and perforated line forming device of the invention is incorporated.

Although the printer of FIG. 2 is shown as having a journal paper printing mechanism in which the above-mentioned printing is once performed on a journal paper 9 paid out of a separate journal paper supply roll 8 and the printed journal paper 9 is wound about a take-up roller 10 as well as the mechanisms for performing the printing, stamping and perforated and severing line forming on the receipt paper blank 1 paid out of a receipt paper blank supply roll 7 as described hereinabove, since the journal paper printing mechanism itself does not constitute any part of the present invention, description of the journal paper printing mechanism will be omitted herein.

In the printer of FIG. 2, the receipt paper blank 1 paid out of the receipt paper blank supply roll 7 is guided along a guide 11 and then passed through the nip defined by a feed roll 12 and an opposing presser roll 13 as the feed roll 12 rotates in increment whereby the receipt paper blank 1 is advanced in increment by a predetermined amount for the printing of each line of the necessary information and the stamping and perforated and severing line formation as will be described hereinafter. In order to rotate the paper feed roll 12 in increment, a ratchet 15 is fixedly mounted on the shaft 14 of the feed roll 12 which is in turn rotatably supported in the machine frame of the printer body and a paper feed pawl 17 is pivoted to a paper and ribbon feed slide plate 16 for engaging and disengaging from the ratchet 15 each time the paper and ribbon feed slide plate 16 makes one reciprocal movement in response to a command from the control circuit (not shown) for the printer as will be described hereinafter. More particularly, when the paper feed pawl 17 engages the ratchet 15 during the outward or rightward movement of the slide plate 16 (as seen in FIG. 2), the pawl 17 rotates the paper feed roll 12 in increment to thereby feed the receipt paper blank 1 by a predetermined amount. The shaft 14 of the ratchet 15 extends through a slot 16*a* in the slide plate 16 to allow the slide plate to move reciprocally.

The slide plate 16 is guided for horizontal movement with respect to the printer machine frame by means of a pin-slot guide arrangement 18 and the paper feed pawl 17 is adapted to be urged to engage the ratchet 15 by means of a spring 19 and to disengage from the ratchet 15 and is held in this disengaged position against the action of the spring 19 when the arm 17*a* of the paper feed pawl 17 is engaged by one arm 21*a* of a paper feed control lever 21 which is urged in the clockwise direction (as seen in FIG. 2) by means of a spring 20. When an electromagnet 22 is energized for a brief time period by the control circuit, the energized electromagnet 22 attracts the other arm 21*b* of the paper feed control lever 21 to cause the paper feed lever 21 to rock in the counterclockwise direction against the action of the spring 20 to disengage the arm 21*b* from the paper feed pawl 17 so as to allow the pawl 17 to engage the ratchet 15 whereby the above-mentioned paper feed is performed during the outward or rightward movement of the slide plate 16. As the slide plate 16 moves in the opposite direction or leftwards, the paper feed pawl 17 is arrested by the paper feed control lever 21 and again held in the position disengaged from the ratchet 15.

There is also provided a stop lever 15*a* to prevent the ratchet 15 from rotating in the reverse direction.

In order to drive the slide plate 16 in its reciprocal movement, a slide plate operation ratchet 24 is secured to a drive shaft 23 which is rotatably supported in the machine frame of the printer to be rotated by the drive source (not shown) of the printer during the operation of the printer. A clutch plate 25 is mounted on the drive shaft 23 in coaxial with the slide plate operation ratchet 24 for free rotation relative to the drive shaft 23 and a pawl lever 27 is pivoted to the clutch plate 25. The pawl lever 27 is urged toward the axis of the clutch plate 25 by means of a spring 26 and has a ratchet pawl 27*a* on the inner or lower side thereof for engaging the ratchet 24. The pawl lever 27 is so shaped that when the ratchet pawl 27*a* engages the ratchet 24, the free end 27*b* of the pawl lever 27 projects beyond the outer periphery of the clutch plate 25 by a small distance. The free end 27*b* of the pawl lever 27 is pivoted to the machine frame of the printer and also pivoted to the printer machine frame adjacent to the free end 27*b* of the pawl lever 27 is a clutch operation lever 29 the free end 29*a* of which is urged to slide along the outer periphery of the clutch plate 25 by means of a spring 28. A stop 25*a* is provided on the clutch plate 25 to be engaged by the free end 27*b* of the pawl lever 27 to hold the clutch plate 25 in a state to restrain the pawl lever 27 in such a position in which the free end 27*b* of the pawl lever 27 is engaged by the free end 29*a* of the clutch operation lever 29 to cause the pawl lever 27 on the clutch plate 25 to disengage its free end 27*b* from the ratchet 24 against the action of the spring 26. The clutch plate 25 is provided with an eccentric cam (not shown) which cooperates with a cam notch formed in the slide plate 16 for receiving the eccentric cam. The eccentric cam is so positioned that while the clutch plate 25 is making one complete rotation from the illustrated position, the eccentric cam causes the slide plate 16 to perform one reciprocal movement in which the slide plate 16 first moves left to right and then from right to left by a predetermined stroke.

In order to impart one complete rotation to the clutch plate 25, an electromagnet 30 is suitably mounted on the printer machine frame adjacent to the clutch operation lever 29 for cooperating with the lever. When the electromagnet 30 is energized by the printer control circuit for a brief time period, the clutch lever 29 is attracted by the energized electromagnet 30 to be rocked in the counter-clockwise direction against the action of the spring 28 to disengage from the lever 27 whereupon the pawl lever 27 is allowed to rock toward the axis of the clutch lever 25 under the action of the spring 26 to cause the ratchet pawl 27*a* to engage the ratchet 24 whereby the clutch plate 25 rotates to cause the slide plate 16 to reciprocally move as mentioned hereinabove. When the clutch plate 25 has finished one complete rotation and the slide plate 16 has completed one reciprocal movement, the electromagnet 30 is deenergized to allow the pawl lever 27 to rock in the clockwise direction to the initial position under the action of the spring 28 whereupon the free end 27*b* of the pawl lever 27 is engaged by the free end 29*a* of the clutch operation lever 29 to allow the clutch lever 27 to rock away from the axis of the clutch plate 25 to the illustrated position in which the clutch lever 27 is engaged by the stop 25*a* on the clutch plate 25 to thereby hold the clutch plate 25 in the illustrated position.

A ribbon feed lever 32 abuts against the right-hand end 16*b* of the slide plate 16 and the ribbon feed lever which extends through a slot 31 in the machine frame is normally urged to this abutting position by means of a spring 33 so as to follow the reciprocal movement of the slide plate 16 to thereby drive a ribbon feed mechanism (not shown) which in turn operates a pair of ribbon spool shafts 34 alternately in the conventional manner. The alternate operating of the pair of ribbon spool shafts 34 passes ribbon 35 extending between and trained about the ribbon spools mounted on the associated ribbon spool shafts along guide rollers 36 to a position adjacent to the periphery of a printing wheel 37. The ribbon feed arrangement is so designed that whenever either one of the spools on the spool shafts has the ribbon 35 wound thereabout by a predetermined amount, the movement direction of the ribbon is reversed.

The printing operation on the receipt paper blank 1 is performed in the conventional manner, that is, a printer hammer (not shown) is actuated by a selector lever (not shown) which is selectively operated in response to a printing command from the control circuit so as to strike against the receipt paper blank 1 positioned about the printing wheel 37 with the ribbon 35 interposed between the paper and a character type which has been selected out of a plurality of character type on the printing wheel 37 and then positioned in the printing position.

As mentioned hereinabove, the stamping operation is selectively performed on the receipt paper blank 1 in timed relation to a predetermined printing operation and in order to form the perforated line and/or severing line on the paper blank, a stamping device 40 is supported on a stamping device support plate 39 adapted to be guided on a base plate 38 and cutting blade 48 is secured to a cutting blade support plate 42 adapted to be guided on a cutting device base plate 41, respectively.

The stamping device support plate 39 is designed to be operated from an electromagnetic device or stamping plunger 44 adapted to be energized by the printer control circuit through an operation lever or stamping lever 45 pivoted to the printer machine frame. The stamping lever 45 is normally urged in the clockwise direction by means of a spring 46 to hold the stamping device in its inoperative position and when the stamping plunger 44 is energized by the printer control circuit, the energized stamping plunger causes the stamping lever 45 to rock in the counterclockwise direction against the action of the spring 46 which then moves the stamping device 40 toward the receipt paper blank 1 being guided along a paper guide and support plate 47 secured to the printer machine frame to thereby perform the stamping operation on the receipt paper blank 1 as will be described hereinafter.

The cutting blade support plate 42 is operated by a double lever mechanism pivoted to the printer machine frame, that is, the cutting blade support plate 42 is interlocked with a paper cutting lever 48 which is in turn resiliently connected to a paper cutting operation lever 148 through a spring 149. Thus, as the paper cutting operation lever 148 moves in relation to the reciprocal movement of the slide plate 16 in response to a command from the printer control circuit as will be described hereinafter, the lever 48 resiliently follows the movement of the lever 148 to thereby selectively operate a switching lever 55 (of which description will be made hereinafter) so as to form the perforated line on the receipt paper blank 1 or cut the paper blank.

Figure 3:
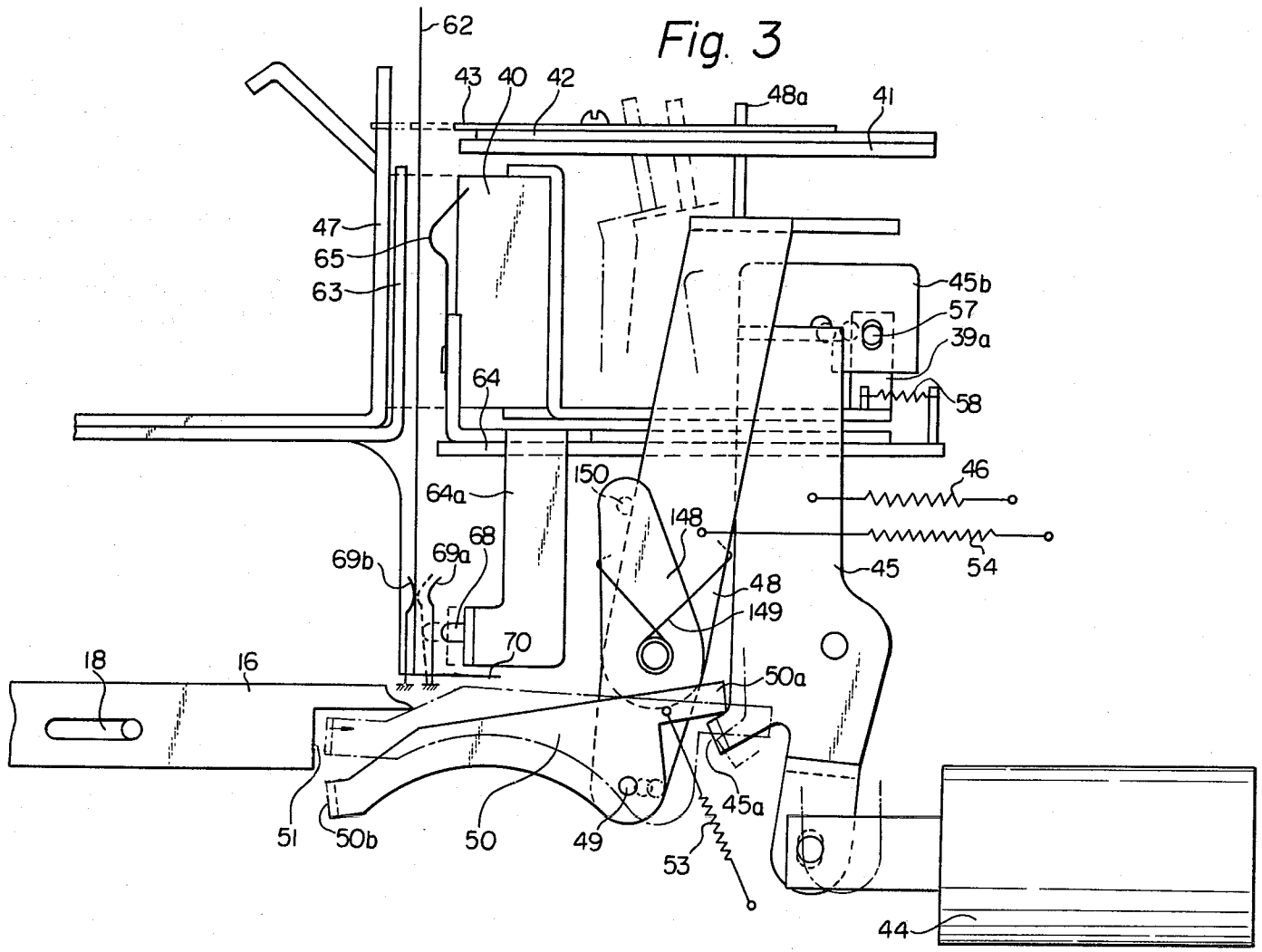
FIG. 3 is a fragmentary side elevational view on an enlarged scale of FIG. 2.
Figure 4:
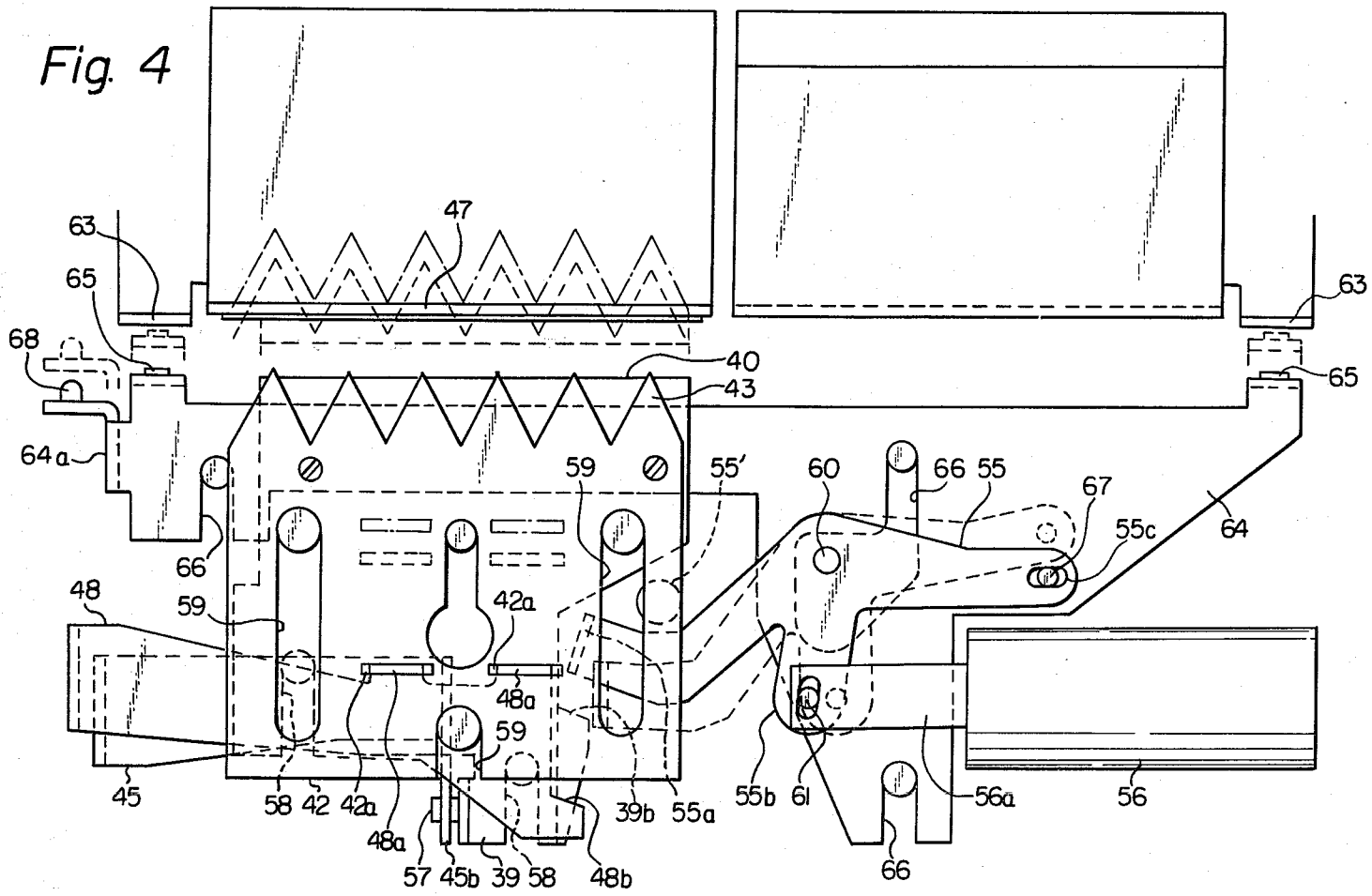
FIG. 4 is a top plan view of FIG. 3.

The stamping device 40 and cutting blade 43 are operated in a predetermined operative relationship to each other and the related operation of the stamping device and cutting blade will be now in detail described referring to FIGS. 2 through 4.

The paper cutting lever 48 and paper cutting operation lever 148 are coaxially pivoted to the printer machine frame by means of a common stub shaft. The lever 48 is urged to rock toward the lever 148 in the paper cutting direction by means of the spring 149 and the lever 148 is provided with a stop pin 150 against which the inner edge of the 48 abuts to be held in a predetermined angular position relative to the lever 148.

The provision of the double lever mechanism provides the advantage that when the cutting device of the printer is subjected to any abnormally high load, the double lever mechanism absorbs the load to thereby protect the cutting device against potential damage.

The stamping lever 45 is formed with a bent **45*a* and one arm 50*a* of a substantially T-shaped slide plate connection lever 50 cooperates with the above-mentioned bent 45*a* whereas a bent 50*b* on the other arm of the lever 50 selectively engages an engaging shoulder 51 formed on the slide plate 16. The lever 50 is biased by a spring 53 so as to cause the bent 50*b* to engage the shoulder 51. The paper cutting lever 48 itself is urged in the clockwise direction and the paper cutting operation lever 148 is also biased in the clockwise direction by means of the spring 149. The lever 48 is provided at the upper end with an upright piece 48*a* which engages in and extends through the cutting blade support plate 42 which is limited in its movement distance by the paper cutting device base plate 41. Since the paper cutting lever 48 is biased by the spring 54, the cutting blade support plate 42 is normally held in the retracted position. When the stamping plunger 44 is in its deenergized position, the arm 50*a* of the lever 50 is engaged by the bent 45on the stamping lever 45 so that the lever 50 is held in a rocked position in the counterclockwise direction against the action of the spring 53 and the bent 50*b* on the lever 50 is disengaged from the shoulder 51 on the slide plate 16 whereby the slide plate connection lever 50 is held in its stationary position regardless of the reciprocal movement of the slide plate 16. Thus, the paper cutting operation lever 148 and accordingly, the cutting blade 43** is held in its inoperative position.

When the stamping plunger 44 is energized, the stamping lever 45 is rocked in the counterclockwise direction whereby the stamping device 40 performs the stamping operation on the receipt paper blank 1 and the bent **45*a* on the stamping lever 45 moves downwardly and therefore, the slide plate connection lever 50 is rocked in the clockwise direction under the action of the spring 53 to cause the bent 50*b* on the lever 50 to engage the engaging shoulder 51 on the slide plate 16 and as the slide plate 16 moves rightwards, the paper cutting operation lever 148 is rocked by a predetermined angle in the counterclockwise direction and the paper cutting lever 48 is also rocked in the counterclockwise direction resiliently following the rocking movement of the paper cutting operation lever 148. However, the rocking movement distance of the paper cutting lever 48 in the counterclockwise direction is selectively regulated by the switching lever 55 (FIG. 4) depending upon whether the paper cutting or perforated line forming operation is performed as will be described hereinafter. When the paper cutting operation is to be performed, the switching plunger 56 is actuated to rock the switching lever 55 in the counterclockwise direction away from the paper cutting lever 48 and thus, the paper cutting lever 48 is allowed to rock throughout the full rocking stroke to move the cutting blade support plate 42 engaging the upright piece 48***a* of the paper cutting lever 48 leftwards by a great distance together with the cutting blade 43 supported on the support plate 42 whereby the cutting edge of the cutting blade 43 passed through a groove 47*a* in the paper guide and support plate 47 to sever the printed receipt paper 6 off the remaining portion of the receipt paper blank 1.

Then the perforated line forming operation is to be performed, the stamping plunger 44 is energized as in the case of the paper cutting operation to rock the stamping lever 45 in the counterclockwise direction. However, in this case, the switching plunger 56 is not energized. As the slide plate 16 moves rightwards, while the paper cutting operation lever 148 is being rocked throughout the predetermined full rocking stroke, the paper cutting lever 48 resiliently rocks in the clockwise direction away from the paper cutting operation lever 148 against the action of the spring 149 while the lever 148 is being continuously rocked in the counterclockwise direction to thereby limit the advancing movement amount of the cutting blade 43 to a value less than the full advancing movement amount necessary to cut the paper blank 1 to allow the cutting blade to perform only the perforated line forming operation because the engaging shoulder 48*b* formed on the horizontal bent at the upper end of the paper cutting lever 48 is engaged and held by the engaging arm 55*a* of the switching lever 55 which is held in the solid line position (FIG. 4) by the deenergization of the switching plunger 56.

Details of the construction and arrangement of the various components for performing the above-mentioned operation procedure will be now described referring to FIG. 4. The stamping device support plate 39 is guided for back and forth slidable movement with respect to the base plate 38 by means of a pin-slot guide arrangement 59 and pulled backwardly by the action of the spring 58 as shown in FIG. 3.

And as shown in FIG. 4, the cutting blade support plate 42 is guided for back and forth slidable movement with respect to the base plate 41 by means of the pin-slot guide arrangement 59. The upright piece 48*a* at the upper end of the paper cutting lever 48 engages in and extends through a groove 42*a* formed in the support plate 42 whereby the support plate 42 is moved back and forth as the paper cutting lever 48 rocks.

The switching lever 55 has a substantially T-shape and is pivoted in the center thereof to the printer machine frame by means of a pivot pin 60 as shown in FIG. 4 and the lever 55 further has a downwardly extending arm 55*b* pivoted to the operation rod 56*a* of the switching plunger 56 by means of a pin 61.

In FIG. 4, the switching lever 55 is in a rocked position as shown by the broken line and disengaged from the engaging shoulder 48*b* on the paper cutting lever 48 when the switching plunger 56 is energized. When the stamping plunger 44 is energized, the stamping lever 45 is rocked to the chain line position to perform the stamping operation and also rocks the slide plate connection lever 50 to the chain line position in which the bent 50*b* on the slide plate connection lever 50 engages the engaging shoulder 51 on the slide plate 16. And thus, as the slide plate 16 moves rightwards, the paper cutting operation lever 148 is rocked to the chain line position to allow both the paper stamping and cutting operations to be performed. And when the switching plunger 56 is in its deenergized position, the switching lever 55 is in the solid line position as shown in FIG. 4 in which the bent 55*b* on the switching lever 55 engages the engaging shoulder 48*b* on the paper cutting lever 48. When the stamping plunger 44 is energized, the stamping lever 45 is rocked to perform the stamping operation. However, as mentioned hereinabove, whereas the paper cutting operation lever 148 is rocked to the predetermined full angular distance by the slide plate 16 through the slide plate connection lever 50, since the engaging shoulder 48*b* on the paper cutting lever 48 is engaged by the bent 55*b* on the switching lever 55, the cutting lever 43 is allowed to advance precisely by a distance just enough to form the perforated line on the receipt paper blank 1, but not to sever the paper blank.

In the embodiment described hereinabove, as the drive source for the printer, a motor is employed, for example, but a solenoid mechanism is equally employed as the drive source. And the slide plate 16 can be driven from a drive source separate from the drive source for the printer.

According to the present invention, the control circuit can be so designed that a single bill paper blank 62 fed in the printer is printed a total sum thereon, for example, other than the printing on a rolled receipt paper blank as mentioned hereinabove.

For the purpose, bill paper blank support plates 63 are secured to the opposite sides of the paper guide and support plate 47 and the leaf spring 65 of a bill paper blank holding-down lever 64 is provided in opposition to and in abutment against the support plates to support and guide the bill paper blank 62 in a stabilized condition.

The holding-down lever 64 is guided for back and forth slidable movement by means of a pin-slot guide arrangement 66 and the movement of the holding-down lever is effected by the common utilization of the switching plunger 56 associated with the stamping and paper cutting operations. For the purpose, a pin 67 on the holding-down lever 64 engages in a slot 55*c* in the other arm of the switching lever and the switching plunger 56 is energized in response to a single bill paper blank printing command from the printer control circuit to rock the switching lever 55 in the counterclockwise direction whereupon the holding-down lever 64 is advanced to urge the holding-down spring 65 against the support plates 63 to thereby perform the printing operation on the single bill paper blank 62 in a stabilized condition.

Furthermore, according to the present invention, in order to eliminate any erroneous printing on the single bill paper blank when the paper blank is not inserted in the proper printing position in the printer, a depending bent piece 64*a* is attached to the side of the holding-down lever 64 which is provided with a projection 68. Thus, when the holding-down lever 64 is advanced, the projection 68 pushes a movable contact 69*a* of a detection switch device to cause the movable contact to engage a stationary contact 69*b* of the same detection switch device to thereby close the circuit of the detection switch device.

The detection switch device is operatively connected to the control circuit and designed to prevent the printing operation when the detection switch device is closed.

The lower edge of the single bill paper blank 62 is adapted to abut against and is supported by an abutment 70 when the bill paper blank is inserted into the proper printing position in the printer. The detection switch device is positioned adjacent to the abutment 70 and the bill paper blank is adapted to be inserted into between the contacts *69a, 69b.*

Thus, only when the bill paper blank 62 is positioned in the proper printing position with the lower edge of the paper bill blank in abutment against the abutment 70, the bill paper blank is positioned between the contacts *69a, 69b.* With the bill paper blank 62 positioned in the proper position, when the holding-down lever 64 advanced to the printing position, the detection switch device is prevented from closing by the insulative property of the bill paper blank 62 to thereby make it possible to perform the printing operation on the bill paper blank.

As mentioned hereinabove, according to the present invention, whereas the movement of the slide plate by a predetermined amount operates the stamping lever which in turn rocks the slide plate connection lever and the rocking of the slide plate connection lever rocks the paper cutting operation lever by a predetermined amount, the selective operation of the switching lever causes the paper cutting lever to selectively cut the paper or form the perforated line on the paper and therefore, the paper cutting and perforated line forming device has a simple construction and operates positively.

Furthermore, the slide plate 16 is provided with a projection 151 (FIG. 2) which is adapted to positively push the paper cutting operation lever 148 at the lower end of the latter to cause the lever to rock positively in clockwise direction as the slide plate 16 moves on the return stroke or leftwards of its reciprocal movement whereby the paper cutting lever 48 can positively return to the initial position after one paper cutting operation has completed. With the arrangement, the cutting blade 43 as well as the paper can be positively prevented from being entrapped within the groove 47a in the paper guide and support plate 47.

Figure 5:
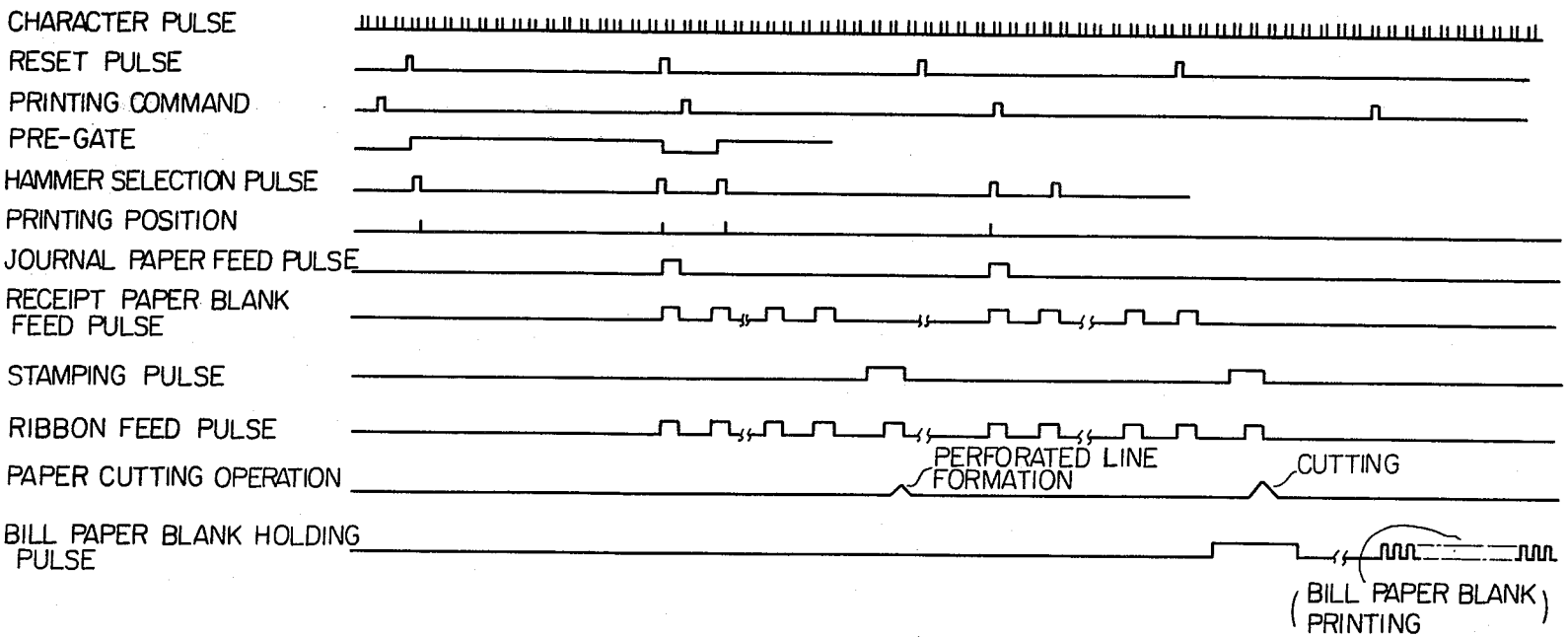
FIG. 5 is a time chart showing the operation sequence of said printer incorporating the paper cutting and perforated line forming device of the invention therein.

The operation sequence of the various components of the printer described hereinabove will be briefly described hereinbelow referring to FIG. 5. When the printer is started, the drive motor (not shown) is energized and a character pulse is provided to the control circuit for operating the components of the printer in a predetermined sequence. A reset pulse is produced when each predetermined printing cycle has completed to reset the control circuit. When the operator gives a printing command, the pregate of the control circuit is opened after a predetermined or selected character pulse has been produced and the printing operation is performed on the portion of the receipt paper blank following the stamp receiving portion of the receipt paper blank already stamped by a selected character type on the printing wheel rotating in response to a predetermined hammer selection pulse until a reset pulse is produced and each time the printing for one line of the necessary information has been completed, the electromagnets 30 and 32 are energized for a brief time period in response to a command from the control circuit to thereby feed the receipt paper blank and ribbon in increment. At the moment when the printing for the one line of the necessary information has been completed, journal paper feed, receipt paper blank feed and ribbon feed signals are produced to repeat the same printing operation sequence in response to successive commands from the control circuit. While repeating the printing sequence, receipt paper blank feed and ribbon feed signals are produced for the printing cycle of each line of the information to energize the electromagnets 30 and 32.

After a predetermined number of lines of the necessary information have been printed on the receipt paper blank, the portion of the receipt paper blank where the perforated line is to be formed is positioned in the position in alignment with the cutter blade, a stamping pulse is produced to energize the stamping plunger 44. In this case, since no receipt paper blank holding-down pulse is produced for energizing the switching plunger 56, the switching lever 55 is in its operative position and the cutting blade is operated to form the perforated line on the receipt paper blank in the manner described hereinabove.

Next, a receipt paper blank feed pulse is produced to advance the receipt paper blank so as to position the portion to be formed the severing line thereon in the position in alignment with the cutter blade whereupon a stamping pulse is produced. Prior to the producing of the stamping pulse, a receipt paper blank holding-down pulse is produced so as to retract the switching lever and thus, the stamping device and cutter blade are caused to advance throughout the full stroke to perform the stamping and cutting operations, respectively.

When a single bill paper blank is to be printed, a bill paper blank holding-down pulse is provided to the switching plunger as an intermittent pulse, but the bill paper blank holding-down action is still properly maintained.

In the foregoing, although description has been made of the arrangement in which the slide connection lever engages the stamping lever and selectively engages the slide plate upon the energization of the stamping plunger, the present invention is also applicable to the arrangement in which separate from the stamping lever, a member is provided for engaging the slide plate connection lever and selectively operated by a separate electromagnetic device whereby the paper cutting and perforated line forming operations are selectively performed independent of the operation of the stamping device.

In the illustrated embodiment, although the slide plate 16 has been described as being slidable, the slide plate may be arranged to pivot with respect to the printer machine frame without substantially modifying the related parts within the scope of the invention.

While only one embodiment of the invention has been shown and described in detail, it will be understood that the same is for illustration purpose only and not to be taken as a definition of the invention, reference being had for this purpose to the appended claims.

What is claimed is:

1. A paper cutting and perforated line forming device for a printer comprising a slide plate mounted on the machine frame of said printer for one reciprocal movement by a predetermined stroke in relation to the printing operation in the printer, a paper cutting lever device pivoted to said printer machine frame and operatively connected to the paper cutting device of said printer, said paper cutting lever device being normally biased in one direction by a spring and adapted to move said paper cutting device to the operative position when the lever device is rocked in the opposite direction against the action of said spring, a slide plate connection lever pivoted to said paper cutting lever device for selectively engaging said slide plate, said slide plate connection lever being adapted to rock said paper cutting lever device when the slide plate connection lever is engaged by said slide plate as the slide plates moves on the outward stroke of the reciprocal movement, a slide plate connection lever operation member engaging said slide plate connection lever and adapted to be operated by an electromagnetic device to cause said slide plate connection lever to selectively engage said slide plate, a switching lever so disposed that when operated, said switching lever is moved out of the operation paths of both said paper cutting device and paper cutting lever device and when not operated, the switching lever moves into the operation path of one of said paper cutting device and paper cutting lever device to regulate the operation stroke of the paper cutting device to a distance just sufficient to form a perforated line on a paper and an electromagnetic device for selectively operating said switching lever, said paper cutting lever device comprising a first lever having said slide plate connection lever pivoted thereto and pivoted to said printer machine frame and a second lever pivoted to said printer machine frame and connected to said paper cutting device to be resiliently urged toward said first lever in the paper cutting direction by a spring and resiliently restrained in a predetermined angular position with respect to the first lever by a stop, whereby the operation stroke distance of said slide plate connection lever as said slide plate moves is set constant so that said first lever rocks by a constant angle and the rocking movement angle of said second lever is selectively regulated by the selective operation of said switching lever to make it possible to selectively cut said paper and form a perforated line on the paper.

2. The paper cutting and perforated line forming device of a printer as set forth in claim 1, in which said slide plate is formed with a projection adapted to engage said first lever as the slide plate moves on the return stroke of the reciprocal movement.

3. A paper cutting and perforated line forming device of a printer comprising a slide plate mounted on the machine frame of said printer for one reciprocal movement by a predetermined stroke, a paper cutting lever device pivoted to said printer machine frame and operatively connected to the paper cutting device of the printer, said paper cutting lever device being normally biased in one direction by a spring and adapted to move said paper cutting device to the operative position when the lever device is rocked in the opposite direction against the action of said first spring, a slide plate connection lever pivoted to said paper cutting lever device for selectively engaging said slide plate, said slide plate connection lever being adapted to rock said paper cutting lever device in said opposite direction when the slide plate connection lever is engaged by said slide plate as the slide plate moves on the outward stroke of the reciprocal movement, a stamping lever pivoted to said printer machine frame and operatively connected to the stamping device of said printer, said stamping lever being normally biased in said first direction and adapted to move said stamping device to the operative position when the stamping lever is rocked in said opposite direction against the action of said second spring, an electromagnetic device rocking said stamping lever in said opposite direction against the action of said second spring, an engaging portion formed on said stamping lever for engaging said slide plate connection lever so as to cause the slide plate connection lever to selectively engage said slide plate when said stamping lever is rocked by the operation of said electromagnetic device, a switching lever disposed to move out of the operation path of said paper cutting lever to allow said paper cutting device to cut a paper when said switching lever is operated and move into the operation path of said paper cutting lever device to limit the operation stroke of the paper cutting device to a distance just sufficient to form a perforated line on said paper when the switching lever is in the inoperative position and an electromagnetic device selectively operating said switching lever, said paper cutting lever device comprising a first lever having said slide plate connection lever pivoted thereto and pivoted to said printer machine frame and a second lever pivoted to said printer machine frame and connected to said paper cutting device, said second lever being biased toward said first lever in the paper cutting direction by a spring and resiliently restrained in a predetermined angular position with respect to the first lever by a stop, whereby the operation stroke distance of said slide plate connection lever as said slide plate moves is set constant so that the rocking movement angle of said second lever is selectively regulated by the selective operation of said switching lever to make it possible to selectively cut said paper and form a perforated line on the paper.

4. The paper cutting and perforated line forming device of a printer as set forth in claim 3, in which said slide plate is formed with a projection adapted to engage said first lever as the slide plate moves on the return stroke of the reciprocal movement to thereby positively rock the slide plate back to the initial position.

5. The paper cutting and perforated line forming device of a printer as set forth in any one of claims 3 and 4, in which said switching lever is operated by said electromagnetic device associated with the switching lever to engage said stamping lever so as to selectively prevent the operation of the stamping lever when the stamping lever is rocked by said electromagnetic device associated with the stamping lever.

6. The paper cutting and perforated line forming device as set forth in claim 5, in which said switching lever and said electromagnetic device associated with the switching lever concurrently serve to selectively operate said paper cutting device.

7. A paper cutting and perforated line forming device for a printer comprising a slide plate mounted on the machine frame of said printer for one reciprocal movement by a predetermined stroke in relation to the printing operation in the printer, a double paper cutting lever mechanism pivoted to said printer machine frame and operatively connected to the paper cutting device of said printer, said double paper cutting lever mechanism being normally biased in one direction by a spring and adapted to move said paper cutting device to the operative position when the lever mechanism is rocked in the opposite direction against the action of said spring, a slide plate connection lever pivoted to said double paper cutting lever mechanism for selectively engaging said slide plate, said slide plate connection lever being adapted to rock said double paper cutting lever mechanism when the slide plate connection lever is engaged by said slide plate as the slide plate moves on the outward stroke of the reciprocal movement, a switching lever so disposed that when operated, said switching lever is moved out of the operation paths of both said paper cutting device and double paper cutting lever mechanism and when not operated, the switching lever moves into the operation path of one of said double paper cutting mechanism and paper cutting device to regulate the operation stroke of the paper cutting device to a distance just sufficient to form a perforated line on a paper and an electromagnetic device for selectively operating said switching lever, said double paper cutting lever mechanism comprising a paper cutting operation lever having said slide plate connection lever pivoted thereto and a paper cutting lever resiliently connected to said paper cutting operation lever to be resiliently urged toward said cutting operation lever in the paper cutting direction and resiliently restrained in a predetermined angular position with respect to the paper cutting operation lever, whereby when said cutting device is subjected to an abnormal load in cutting said paper, said double lever mechanism absorbs the abnormal load so as to protect the cutting device against potential damage.

* * * * *